US006796086B2

(12) United States Patent
Albenda

(10) Patent No.: US 6,796,086 B2
(45) Date of Patent: Sep. 28, 2004

(54) SAFETY DEVICE FOR HINGED DOORS

(76) Inventor: Abraham Albenda, 276 Exeter St., Brooklyn, NY (US) 11235

( * ) Notice: Subject to any disclaimer, the term of this patent is extended or adjusted under 35 U.S.C. 154(b) by 0 days.

(21) Appl. No.: 10/306,359

(22) Filed: Nov. 27, 2002

(65) Prior Publication Data

US 2004/0098916 A1 May 27, 2004

(51) Int. Cl.[7] ..... E05D 11/00
(52) U.S. Cl. ..... 49/383
(58) Field of Search ..... 49/383; 160/40; 16/250, 251

(56) References Cited

U.S. PATENT DOCUMENTS 5,001,862 A * 3/1991 Albenda ..... 49/383
5,220,708 A * 6/1993 Lucas et al. ..... 16/225
5,359,812 A * 11/1994 Mayfield ..... 49/383
5,419,084 A * 5/1995 Sankey et al. ..... 49/383

FOREIGN PATENT DOCUMENTS

WO WO 93/18268 * 9/1993 ..... 49/383

* cited by examiner

*Primary Examiner*—Jerry Redman
(74) *Attorney, Agent, or Firm*—Frishauf, Holtz, Goodman & Chick, P.C.

(57) ABSTRACT

Safety device for preventing injury by shielding body parts from a gap between a door and a door frame including a one-piece protective sheet having a plurality of flaps each extending over only a portion of the height of the sheet and which are foldable about one another. The sheet is partitioned by transverse fold lines or bends extending between the lateral edges of the sheet on one side of the sheet. The flaps are connected to one another on an opposite side of the sheet and thus pivotable with respect to one another to enable the sheet to fold into a compact form for shipping and storage regardless of the vertical height of the device. Attachment mechanisms attach lateral edge portions of the sheet to the door and door frame.

51 Claims, 3 Drawing Sheets

SAFETY DEVICE FOR HINGED DOORS

FIELD OF THE INVENTION

The present invention relates generally to a safety and protective device for hinged doors which prevents injury to individuals or animals by stopping objects from entering a gap between the hinged door and the adjacent part of the door frame.

More specifically, the present invention relates to a safety and protective device for hinged doors which prevents objects from entering a gap between the hinged door and the door frame and which is folded about transverse fold lines to provide the device with a compact form for easy packaging.

BACKGROUND OF THE INVENTION

When a door is hinged to a door frame, a vertical gap between the door and the adjacent door frame is formed whenever the door is ajar, but is not present when the door is closed. Children, adults and animals are often injured when fingers and other body parts are placed into the gap while the door is in its open position and then the door is closed crushing the fingers and other body parts between the door and the door frame.

A prior art attempt to prevent such injuries from occurring is shown in U.S. Pat. No. 474,633 in which a flat sheet of material extends outwardly far from the door in some operative positions.

Another prior art attempt to prevent such injuries from occurring is shown in U.S. Pat. No. 5,001,862 in which a foldable protective member or device extends over at least a portion of the height of the front and/or rear face of the door. The protective member is foldable only along a vertical axis and may be accordion-like or in the shape of a recoiling tube. The protective member expands and contracts to cover a gap created when the door opens thereby providing protection against the insertion of fingers and other body parts into the gap. A larger protective member, larger in the vertical direction, would provide greater closure of the gap between the door and the door frame when the door is open and thus greater protection against the insertion of fingers and other body parts.

However, it is a drawback of this protective member that it is not foldable in a transverse direction so that the packaging required for the protective member must have the same or a larger vertical dimension than the protective member. This results in an awkward packaging when the vertical height of the protection member is relatively large, especially since the protective member may be as large as a door, which is at least about 7 feet high.

OBJECTS AND SUMMARY OF THE INVENTION

It is an object of the present invention to provide a new and improved safety or protective device for closing a gap between a hinged door and a door frame which can be conveniently packaged regardless of the vertical height of the protective device.

It is another object of the present invention to provide a new and improved safety or protective device for closing a gap between a hinged door and a door frame which is easily stored.

In order to achieve these objects, a protective device for preventing injury by shielding body parts from a gap between a door and a door frame in accordance with the invention comprises a one-piece protective sheet having a plurality of vertical sections or flaps each extending over only a portion of the height of the sheet and which are foldable about one another to thereby enable the sheet to have a reduced height when folded about the flaps. To form the flaps, the sheet is partitioned by one or more transverse fold lines or bends extending between the lateral edges of the sheet on one side of the sheet. The flaps are connected to one another on an opposite side of the sheet and thus pivotable with respect to one another to enable the sheet to fold into a compact form for shipping and storage regardless of the vertical height of the device. For larger devices, more fold lines and flaps would be provided so that the device would still have a compact form.

The device also includes attachment mechanisms for attaching a lateral edge portion of the sheet to the door and an opposite lateral edge portion to the door frame. The attachment mechanisms may be an adhesive with a removable backing layer, or screws, nails and the like. In use when attached to the door and door frame, the protective device will cover the entire gap between the door and the door frame, regardless of the degree of opening of the door, and prevent entry of fingers and other body parts into the gap between the door and the door frame.

In one embodiment, the sheet may be made of corrugated plastic having an inward planar layer adapted to face the gap between the door and the door frame, an outward planar layer coextensive with the inward planar layer and ribs connecting the planar layers together. In the inward planar layer, crimped bends or cuts are formed extending in the vertical direction of the sheet to enable the sheet to bend in the vertical direction inward. In this manner, the sheet can attain a desired flexible form allowing it to flex during the opening and closing movements of the door. The vertical crimped bends or cuts can be arranged in any pattern, spacing and number to provide any desired degree of flexibility.

The lateral edge portions may be pivotally connected to a remaining portion of the sheet. This may be achieved by cutting the inward planar layer of the sheet in a vertical direction alongside each lateral edge portion, in which case, the lateral edge portions are attached to the remaining portion of the sheet by the outward planar layer.

In another embodiment, the sheet may be made of any type of rigid or semi-rigid plastic material with transverse score lines formed on one side of the sheet to enable the sheet to be bent into a compact shipping and storage position. Vertical score lines are also formed on the same side of the sheet to enable the sheet to bend and flex when installed. The vertical score lines can be arranged in any pattern, spacing and number to provide any desired degree of flexibility.

The protective device can cover the entire height of the door or any portion of the height thereof, and can be placed on either or both of the front and rear faces of the door.

As used in the present description and claims, the term "door frame" means any structure to which a door is hinged. In some cases, for example, a door frame per se is not used, i.e., the door is hinged directly to a wall or other support structure. The term "door frame" thus includes any such structure to which a door is hingedly mounted.

BRIEF DESCRIPTION OF THE DRAWINGS

The invention, together with further objects and advantages thereof, may best be understood by reference to the following description taken in conjunction with the accompanying drawings, wherein like reference numerals identify like elements and wherein.

DETAILED DESCRIPTION OF THE PREFERRED EMBODIMENTS

Figure 1:
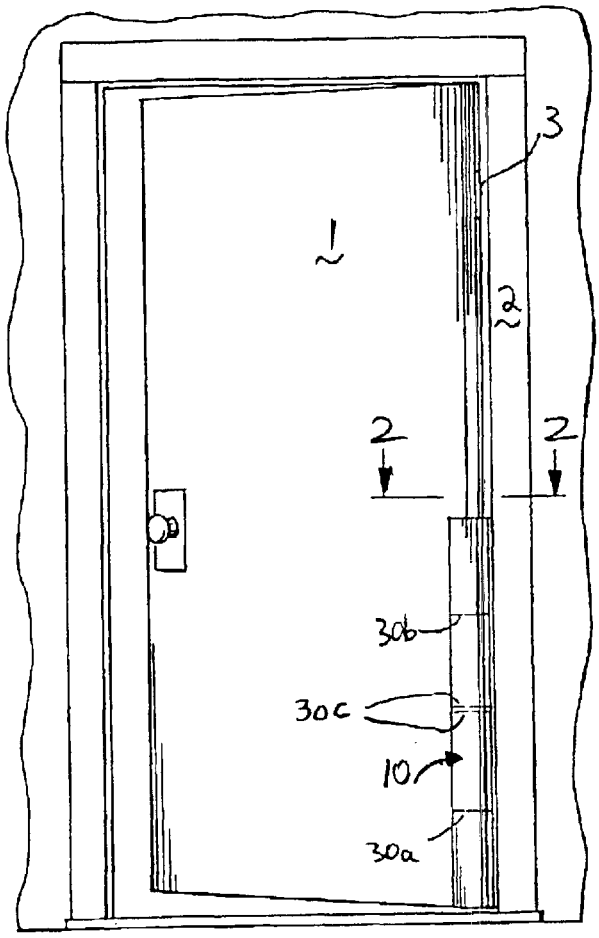
FIG. 1 is a front view of an embodiment of a protective device in accordance with the invention attached to a partially opened door, and with the protective device extending up only partially from the bottom of the door.

Referring first to FIG. 1, FIG. 1 shows a door 1 hingedly mounted to a door frame 2 by hinges 3. A door frame 2 is specifically referred to herein. However, as stated above, the invention is equally applicable to doors hinged directly to a wall or the like, or other support structure, without using a door frame per se. The term "door frame" is being used generally to refer to any type of support structure to which a door is hingedly connected. Hinge 3 may be any known type of door hinge.

Figure 2:
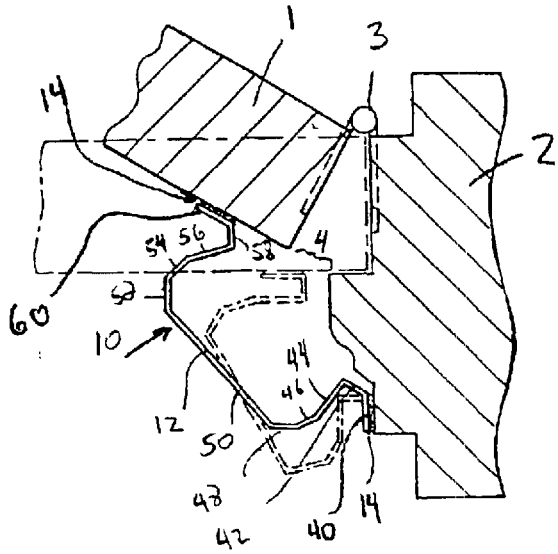
FIG. 2 is a cross-sectional plan view taken along the line 2—2 in FIG. 1.

As shown in FIG. 2, a gap 4 is formed between the door 1 and the door frame 2 whenever the door 1 is open (at least a sufficient amount for the side edge of the door 1 adjacent to the door frame 2 to extend beyond any molding associated with the door frame 2). The size of the gap 4 increases as the door 1 opens. However, the gap 4 is reduced as the door 1 closes until it is eliminated when the door 1 is closed (the position shown in dotted lines). During the closure of the door 1, protection is needed to prevent insertion of fingers and other body parts into the gap 4.

To this end, a protective device or member in accordance with the invention is designated 10 and comprises a single sheet of plastic 12 and attachment mechanisms 14 for attaching the sheet 12 to the door 1 and the door frame 2. The attachment mechanisms 14 are arranged on an inward side of the sheet 12, i.e., on a side of the sheet facing the gap 4, and on lateral edge portions 40,60 of the sheet 12.

Figure 5:
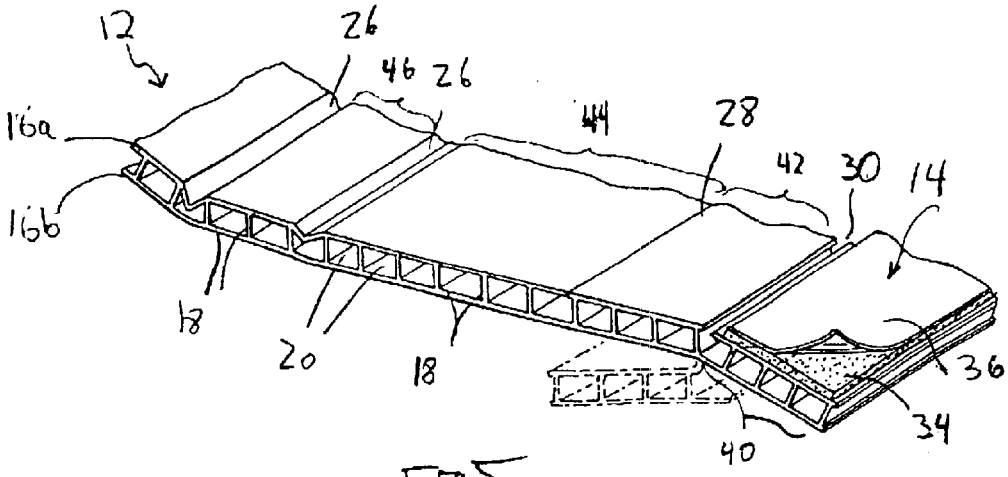
FIG. 5 is a fragmentary perspective view of the vertically extending bends of the protective device in accordance with the invention.

As shown most clearly in FIG. 5, the sheet 12 may be made of corrugated plastic in which opposed, coextensive, substantially planar layers of plastic 16*a*,16*b* are connected by ribs 18 to thereby define cavities 20. The lateral edge portions 40, 60 are formed by providing a separation in the planar layer 16*a* on the inward side of the sheet 12, e.g., by cutting the inward planar layer 16*a* at cuts 22 which may be made between a pair of ribs 18. As such, the lateral edge portions 40,60 remain attached to the outward planar layer 16*b* and can pivot outward (see the lateral edge portion 40 in dotted lines shown in FIG. 5).

Additional vertically extending crimped bends 26 or cuts 28 between pairs of ribs 18 are also formed in the inward planar layer 16*a* of the sheet 12 at predetermined locations and extending over substantially the entire height of the sheet 12 to enable the sheet 12 to be bent along such crimped bends and cuts to achieve the flexibility required during the movement of the door 1 between the open and closed positions. The crimped bends 26 and cuts 28 divide the sheet 12 into a plurality of horizontal sections 42, 44, 46, 48, 50, 52, 54, 56, 58 (see FIG. 2). As used herein, a "horizontal section" is a part of the sheet 12 which extends between the upper and lower edges of the sheet 12 over only a portion of the width of the sheet 12. A horizontal section or flap is thus defined by the upper and lower edges of the sheet and either a pair of crimped bends, a pair of cuts or a crimped bend and a cut. The crimped bends 26 and cuts 28 can thus be said to extend in the vertical direction.

The crimped bends 26 and cuts 28 can be arranged in any pattern, spacing and number to provide any desired degree of flexibility, although they are typically substantially parallel to one another. In addition, it is conceivable that only crimped bends can be used to form the horizontal sections, without any cuts, and that only cuts can be used to form the horizontal sections, without any crimped bends.

Each horizontal section extends from the upper edge of the sheet 12 to the lower edge of the sheet 12 to enable the sheet 12 to bend uniformly over its entire height. In view of the presence of transverse folds discussed below, the crimped bends 26 and cuts 28 may be discontinuous at the transverse folds.

Figure 3:
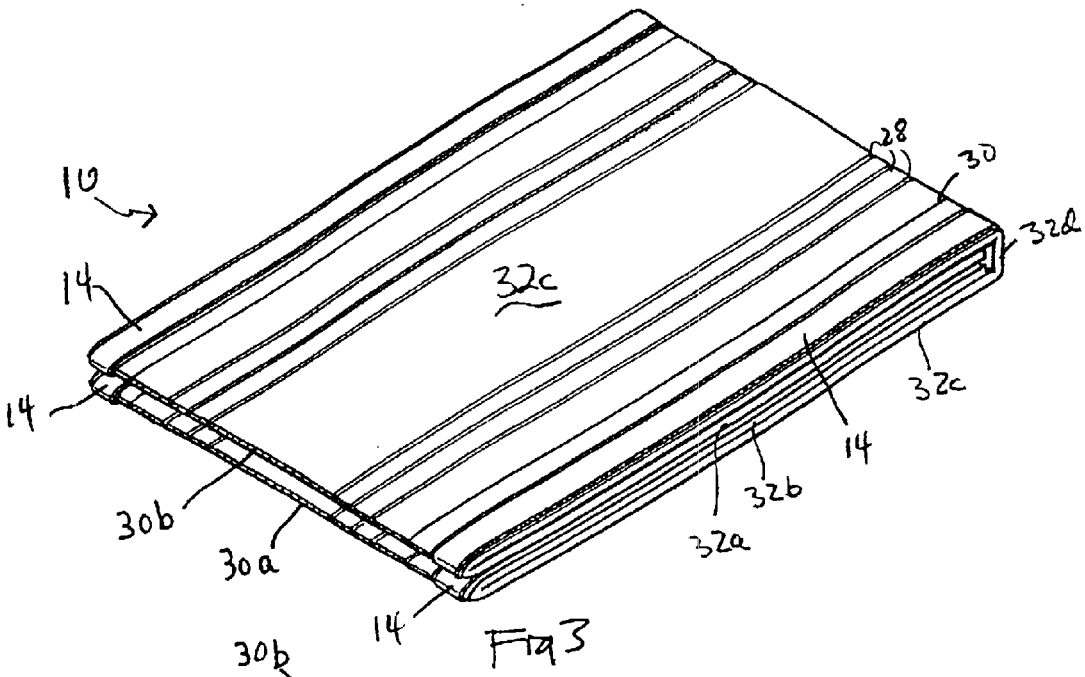
FIG. 3 is a perspective view of the protective device in accordance with the present invention in a storage position in which it can be stored in a box.

In order to provide a compact structure for packaging the protective device 10, transverse fold lines 30 are made in the sheet 12 to enable the sheet 12 to be folded about such transverse fold lines 30 into a compact form as shown in FIG. 3. Each transverse fold line 30 extends between the lateral edges of the sheet 12 at a discrete vertical height to form a plurality of vertical sections or flaps 32.

As used herein, a "vertical section" or "flap" is a part of the sheet 12 which extends between the lateral edges of the sheet 12 over only a portion of the height of the sheet 12. A vertical section or flap is thus defined by the lateral edges of the sheet 12 and either the lower edge of the sheet and a transverse fold line, a pair of transverse fold lines or a transverse fold line and the upper edge of the sheet.

Figure 6:
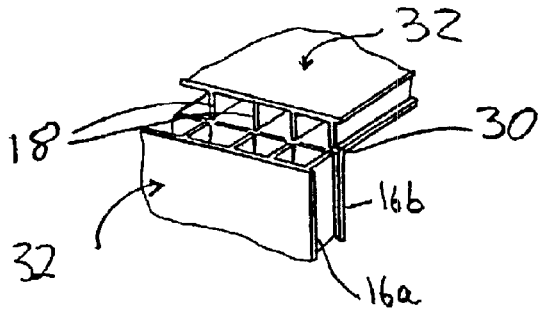
FIG. 6 is a fragmentary perspective view of the transverse fold lines of the protective device in accordance with the invention.

In the illustrated embodiment, to form the fold lines 30, cuts are made in the inward planar layer 16*a* of the sheet 12 at several locations along the height of the sheet 12 with each cut extending fully between the lateral edges of the sheet 12 to thereby form the flaps 32. The cuts may be substantially parallel to the upper and lower edges of the sheet 12 so that when folded, the flaps 32 overlap one another, i.e., they are folded neatly against one another as shown in FIG. 3). The flaps 32 remain attached to one another by means of the outward planar layer 16*b*, which is not cut, and are thus foldable about the fold lines 30 (see FIG. 6).

The fold lines 30 enable the protective device 10 to be bent along transverse axes and thereby assume the compact form shown in FIG. 3. The number of transverse fold lines 30 for a sheet 12 depends on the expanded, operational height of the protective device 10 and the desired folded, storage height of the protective device 10. Although the location of the fold lines 30 may vary depending on the height of the protective device 10, the fold lines should be appropriately located to optimally minimize the size of the protective device 10.

Figure 4:
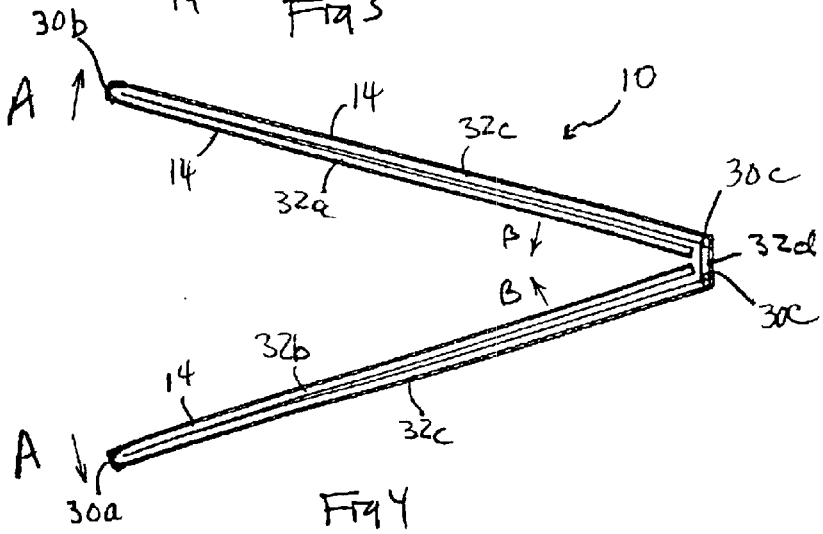
FIG. 4 is a side elevational view of the protective device in accordance with the invention showing the manner in which the device is unfolded and readied for use.

For example, in the illustrated embodiment, a first fold line 30*a* is formed at a set height from the lower edge of the sheet 12 to form a first flap 32*a* and a second fold line 30*b* is formed at the same height from the upper edge of the sheet 12 to form a second flap 32*b*. Two fold lines 30*c* are then made at a slightly greater distance close to the center of the sheet 12 to form additional flaps 32*c* and a small central section 32*d*. The height of the flaps 32*c* is greater than the height of the flaps 32*a*,32*b* so that the flaps 32*a*,32*b* fold against the flaps 32*c* to a distance proximate the central section 32*d* (see FIGS. 3 and 4). In this manner, the size of the protective device 10 is minimized and a package for the protective device 10 which is easy to manufacture, store and ship may be formed. The outer layer of the corrugated material is cut at the fold lines 30*a*, 30*b* and 30*c* to facilitate folding. The cuts could be on the opposite surfaces of the corrugated material, in which case the portions 32*a*, 32*b* will fold outwardly instead of inwardly as shown in FIG. 3.

The attachment mechanisms 14 may comprise a layer of adhesive 34 and a backing layer 36 (see FIG. 5). Use of adhesive as the attachment mechanism prevents damage to the door 1 and door frame 2. Nevertheless, screws, nails and the like could also be used as attachment mechanisms to attach the sheet 12 to the door 1 and the door frame 2.

The protective device 10 may be sold having the form shown in FIG. 3 which can easily be inserted into a rectangular box. To use the protective device 10, the protective device 10 is removed from the box and the flaps 32*a* and 32*b* are separated by moving them in the directions of arrow A in FIG. 4. The flaps 32*a*,32*b* are then separated from the flaps 32*c* by moving them in the directions of arrows B. The flaps 32*a*–32*d* are fully extended until the sheet 12 is straight and thus ready for installation.

To install the protective device 10, the backing layer 36 is removed from the adhesive 34 and the exposed adhesive on one of the lateral edge portions 40,60 is pressed against the door 1 and the adhesive on the other lateral edge portion 40,60 is pressed against the door frame 2. The device can be installed on the front face of the door 1 or the rear face of the door 1. If protection for both sides of the door 1 is desired, then two protective devices would be used.

Figure 7:
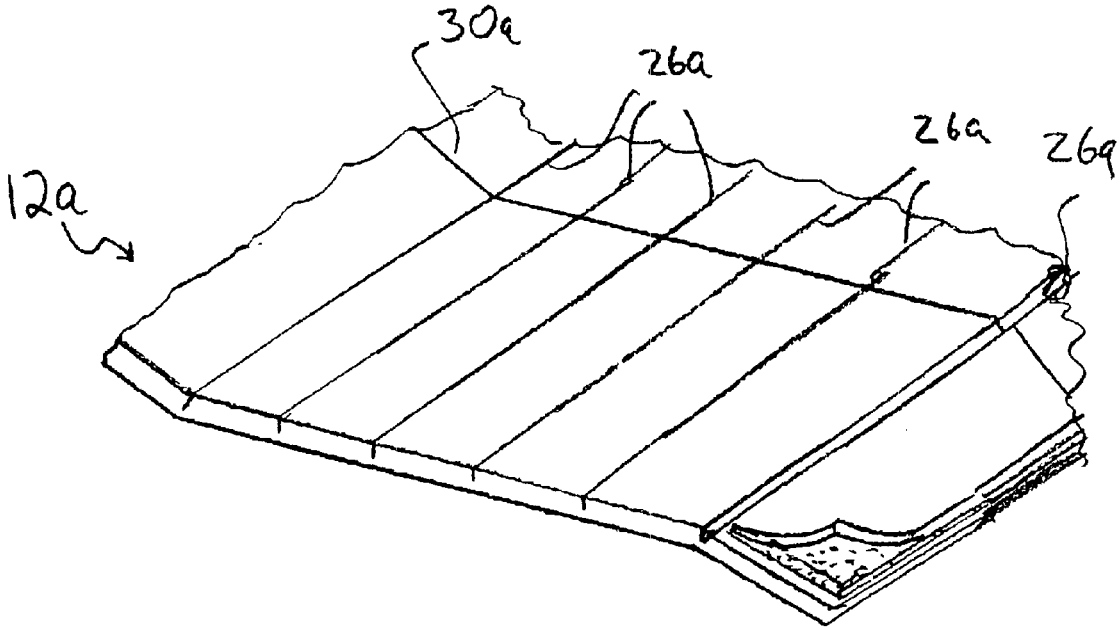
FIG. 7 is a fragmentary perspective view of another embodiment of a protective device in accordance with the invention showing vertically and horizontally extending cuts or score lines.

In another embodiment of the present invention shown in FIG. 7, instead of forming the sheet from corrugated plastic, the sheet 12*a* is made of any type of rigid or semi-rigid plastic material (for example, polypropylene) with transverse cuts, fold lines or score lines 30*a* formed on one side of the sheet 12*a* to enable the sheet 12*a* to be bent transversely for shipping and storage. Vertical cuts, fold lines or score lines 26*a* are also formed on the same side of the sheet 12*a* to enable the sheet 12*a* to bend and flex when installed. The horizontal fold or score lines 30*a* can be arranged in any pattern, spacing and number to provide for any desired degree of compactness. The vertical score lines 26*a* can be arranged in any pattern, spacing and number to provide any desired degree of flexibility and a multitude of different bent forms. Instead of horizontal and vertical cuts, fold lines or score lines, crimped bends and the like can be used.

The vertical and horizontal fold or score lines 26*a*,30*a* extend only partially through the sheet 12*a* as shown in FIG. 7 so that the vertical and horizontal flaps formed upon bending the sheet 12*a* about the fold or score lines 26*a*,30*a* remain attached to one another and can pivot with respect to one another.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A protective device for preventing insertion of body parts into a gap between a door frame and a door hinged to the door frame, comprising:

a one-piece protective sheet having an upper edge, a lower edge opposed to said upper edge and first and second opposed lateral edges, said sheet having a height defined between said upper edge and said lower edge, said sheet having a plurality of flaps each extending over only a portion of the height of said sheet and between said first and second lateral edges of said sheet, said sheet including first and second lateral edge portions extending between said upper and lower edges over a plurality of said flags and encompassing a respective one of said first and second lateral edges, said flaps being foldable against one another;

first attachment means arranged in connection with said first lateral edge portion for attaching said first lateral edge portion over a plurality of said flats to the door; and second attachment means arranged in connection with said second lateral edge portion for attaching said second lateral edge portion over a plurality of said flaps to the door frame such that when said first and second lateral edge portions of said sheet are attached to the door and door frame, each of said flaps extends between the door and the door frame covering the gap between the door and the door frame thereby preventing entry of body parts into the gap.

2. The protective device of claim 1, wherein said sheet comprises at least one transverse fold line interposed between an adjacent pair of said flaps with said flaps being foldable about said fold line.

3. The protective device of claim 1, wherein said sheet comprises a plurality of transverse fold lines each interposed between an adjacent pair of said flaps with said flaps being foldable about said fold lines to form a compact structure with at least three of said flaps being folded against one another.

4. The protective device of claim 1, wherein said sheet comprises four transverse fold lines each interposed between an adjacent pair of said flaps with said flaps being foldable about said fold lines to form a compact structure with four of said flaps being folded against one another.

5. The protective device of claim 1, wherein one side of said sheet is cut or scored between said first and second lateral edges to thereby form a pair of said flaps on the sides of the cut.

6. The protective device of claim 1, wherein one side of said sheet is cut or scored between said first and second lateral edges along a line substantially parallel to said upper and lower edges of said sheet to thereby form a pair of said flaps on the sides of the cut.

7. The protective device of claim 1, wherein one side of said sheet is cut or scored between said first and second lateral edges along lines substantially parallel to said upper and lower edges of said sheet to thereby form a pair of said flaps on the sides of each cut.

8. The protective device of claim 1, wherein said sheet is made of corrugated plastic.

9. The protective device of claim 1, wherein said sheet is made of a rigid or semi-rigid plastic material.

10. The protective device of claim 1, wherein said sheet comprises at least one vertically extending crimped bend parallel to said first and second lateral edges of said sheet to enable said sheet to bend about said at least one crimped bend.

11. The protective device of claim 1, wherein one side of said sheet is cut or scored in a vertical direction parallel to said first and second lateral edges of said sheet to enable one portion of said sheet to pivot with respect to another portion of said sheet about the cut.

12. The protective device of claim 1, wherein one side of said sheet is cut or scored in a vertical direction parallel to said first and second lateral edges of said sheet at a plurality of locations to enable one portion of said sheet to pivot with respect to another portion of said sheet about the cut.

13. The protective device of claim 1, wherein said sheet comprises an inward, substantially planar layer of material adapted to face the gap between the door and the door frame and an outward, substantially planar layer of material coextensive with said inward planar layer and spaced from said inward planar layer.

14. The protective device of claim 13, wherein said sheet comprises at least one vertically extending crimped bend formed in said inward planar layer parallel to said first and second lateral edges of said sheet to enable said sheet to bend about said at least one crimped bend.

15. The protective device of claim 13, wherein said inward planar layer is cut in a vertical direction parallel to said first and second lateral edges of said sheet to enable one portion of said sheet to pivot with respect to another portion of said sheet about the cut.

16. The protective device of claim 13, wherein said sheet further comprises ribs arranged between said inward and outward planar layers to space said outward planar layer from said inward planar layer.

17. The protective device of claim 1, wherein each of said first and second lateral edge portions is pivotally connected to a remaining portion of said sheet.

18. The protective device of claim 1, wherein said sheet comprises an inward planar layer of material adapted to face the gap between the door and the door frame and an outward planar layer spaced from said inward layer, said inward planar layer being cut in a vertical direction parallel to the first and second lateral edges and alongside each of said first and second lateral edge portions such that said first and second lateral edge portions are attached to the remaining portion of said sheet by said outward planar layer.

19. The protective device of claim 1, wherein said first and second attachment means each comprise adhesive means for adhesively attaching the respective one of said first and second lateral edge portions of said sheet to the door and the door frame.

20. The protective device of claim 19, wherein said adhesive means comprise an adhesive layer and a backing layer arranged on said adhesive layer.

21. The protective device of claim 1, wherein said sheet comprises means for defining said flaps.

22. The protective device of claim 21, wherein said means comprise at least one transverse fold line each interposed between an adjacent pair of said flaps with said flaps being foldable about said fold line.

23. The protective device of claim 21, wherein said means comprise cuts or score lines formed on one side of said sheet between said first and second lateral edges such that a pair of said flaps is formed on the sides of each cut or score line.

24. The protective device of claim 1, wherein said sheet comprises means for enabling said sheet to bend in a vertical direction parallel to said first and second lateral edges of said sheet and perpendicular to said upper and lower edges of said sheet.

25. The protective device of claim 24, wherein said means comprise at least one vertically extending crimped bend, cut or score line parallel to said first and second lateral edges of said sheet and perpendicular to said upper and lower edges of said sheet.

26. A one-piece protective device for preventing injury by shielding body parts from a gap between a door and a door frame, comprising:

a protective sheet having an upper edge, a lower edge opposed to said upper edge and opposed lateral edges each extending between said upper edge and said lower edge, said sheet having a vertical dimension defined between said upper edge and said lower edge and a transverse dimension defined between said opposed lateral edges and perpendicular to said vertical dimension, said sheet having means for enabling said sheet to be folded about an axis extending in the transverse dimension;

first attachment means for attaching a lateral edge portion of said sheet including one of said lateral edges to the door; and second attachment means for attaching a lateral edge portion of said sheet including the other of said lateral edges to the door frame such that when said lateral edge portions of said sheet are attached to the door and door frame, said sheet extends between the door and the door frame covering the gap between the door and the door frame thereby preventing entry of body parts into the gap.

27. The protective device of claim 26, wherein said means comprise at least one transverse fold line, said sheet being foldable about said at least one fold line.

28. The protective device of claim 27, wherein each of said at least one fold line extends substantially parallel to said upper and lower edges of said sheet at a respective height between said upper and lower edges.

29. The protective device of claim 27, wherein said sheet is partitioned by each of said at least one fold line into an adjacent pair of flaps with said flaps being foldable about said fold line.

30. The protective device of claim 27, wherein each of said at least one fold line is formed by cutting or scoring one side of said sheet between said lateral edges along a line substantially parallel to said upper and lower edges of said sheet.

31. The protective device of claim 26, wherein said means comprise a plurality of transverse fold lines, said fold lines being formed by cutting or scoring one side of said sheet between said lateral edges along lines substantially parallel to said upper and lower edges of said sheet.

32. The protective device of claim 26, wherein said means comprise a plurality of transverse fold lines, said sheet being partitioned by each of said fold lines into an adjacent pair of flaps with said flaps being foldable about said fold lines to form a compact structure with at least three flaps folded against one another.

33. The protective device of claim 26, wherein said means comprise four transverse fold lines, said sheet being partitioned by each of said fold lines into an adjacent pair of flaps with said flaps being foldable about said fold lines to form a compact structure with four flaps folded against one another.

34. The protective device of claim 26, wherein said sheet is made of corrugated plastic.

35. The protective device of claim 26, wherein said sheet is made of a rigid or semi-rigid plastic material.

36. The protective device of claim 26, wherein said sheet comprises at least one vertically extending crimped bend to enable said sheet to bend about said at least one crimped bend.

37. The protective device of claim 26, wherein one side of said sheet is cut or scored in a vertical direction to enable one portion of said sheet to pivot with respect to another portion of said sheet about the cut.

38. The protective device of claim 26, wherein one side of said sheet is cut or scored in a vertical direction at a plurality of locations to enable one portion of said sheet to pivot with respect to another portion of said sheet about the cut.

39. The protective device of claim 26, wherein said sheet comprises means for enabling said sheet to bend in a vertical direction.

40. The protective device of claim 39, wherein said means for enabling said sheet to bend in a vertical direction comprise at least one vertically extending crimped bend, cut or score line.

41. The protective device of claim 26, wherein said sheet comprises an inward, substantially planar layer of material adapted to face the gap between the door and the door frame and an outward, substantially planar layer of material coextensive with said inward planar layer and spaced from said inward planar layer.

42. The protective device of claim 41, wherein said sheet comprises at least one vertically extending crimped bend formed in said inward planar layer to enable said sheet to bend about said at least one crimped bend.

43. The protective device of claim 41, wherein said inward planar layer is cut in a vertical direction to enable one portion of said sheet to pivot with respect to another portion of said sheet about the cut.

44. The protective device of claim 41, wherein said sheet further comprises ribs arranged between said inward and outward planar layers to space said outward planar layer from said inward planar layer.

45. The protective device of claim 41, wherein each of said lateral edge portions is pivotally connected to a remaining portion of said sheet.

46. The protective device of claim 45, wherein said sheet comprises an inward planar layer of material adapted to face the gap between the door and the door frame and an outward planar layer spaced from said inward layer, said inward planar layer being cut in a vertical direction alongside each of said lateral edge portions such that said lateral edge portions are attached to the remaining portion of said sheet by said outward planar layer.

47. The protective device of claim 26, wherein said first and second attachment means each comprise adhesive means for adhesively attaching the respective one of said lateral edge portions of said sheet to the door and the door frame.

48. The protective device of claim 47, wherein said adhesive means comprise an adhesive layer and a backing layer arranged on said adhesive layer.

49. A protective device for preventing insertion of body parts into a gap between a door frame and a door hinged to the door frame, comprising:

a one-piece protective sheet having a plurality of coextensive flaps vertically arranged along the height of the gap, said flaps being foldable against one another;

first attachment means arranged in connection with a first lateral edge of each of said flaps for attaching each of said flaps directly to the door; and second attachment means arranged in connection with a second lateral edge of each of said flaps for attaching each of said flaps directly to the door frame, said second lateral edge of each of said flaps being opposite to said first lateral edge of said flap such that when said first and second lateral edges of said flaps are attached to the door and the door frame, said flaps extend between the door and the door frame covering the gap between the door and the door frame thereby preventing entry of body parts into the gap.

50. The protective device of claim 49, wherein said first and second attachment means each comprise adhesive means for adhesively attaching the respective one of said first and second lateral edges of said flaps to the door and the door frame.

51. The protective device of claim 50, wherein said adhesive means comprise an adhesive layer and a backing layer arranged on said adhesive layer.

* * * * *